US011049475B2

(12) United States Patent
Lin

(10) Patent No.: US 11,049,475 B2
(45) Date of Patent: Jun. 29, 2021

(54) IMAGE DISPLAY METHOD AND IMAGE DISPLAY SYSTEM CAPABLE OF STABILIZING IMAGE BRIGHTNESS

(71) Applicants: BenQ Intelligent Technology (Shanghai) Co., Ltd, Shanghai (CN); BENQ CORPORATION, Taipei (TW)

(72) Inventor: Hsin-Nan Lin, Taipei (TW)

(73) Assignees: BenQ Intelligent Technology (Shanghai) Co., Ltd, Shanghai (CN); BENQ CORPORATION, Taipei (TW)

( * ) Notice: Subject to any disclaimer, the term of this patent is extended or adjusted under 35 U.S.C. 154(b) by 0 days.

(21) Appl. No.: 16/805,805

(22) Filed: Mar. 1, 2020

(65) Prior Publication Data

US 2020/0302893 A1 Sep. 24, 2020

(30) Foreign Application Priority Data

Mar. 21, 2019 (CN) ..... 201910215269.4

(51) Int. Cl.
*G09G 5/10* (2006.01)

(52) U.S. Cl.
CPC ..... *G09G 5/10* (2013.01); *G09G 2310/08* (2013.01); *G09G 2320/0626* (2013.01); *G09G 2320/0673* (2013.01)

(58) Field of Classification Search
None
See application file for complete search history.

(56) References Cited

U.S. PATENT DOCUMENTS

| | | | | |
|---|---|---|---|---|
| 2016/0042682 | A1* | 2/2016 | Lim | H04N 5/63 345/212 |
| 2019/0004595 | A1 | 1/2019 | Mizuno | |
| 2019/0244572 | A1* | 8/2019 | Le | G09G 3/36 |

FOREIGN PATENT DOCUMENTS

| | | | |
|---|---|---|---|
| CN | 102547318 | A | 7/2012 |
| CN | 102810297 | A | 12/2012 |
| CN | 107424573 | A | 12/2017 |
| TW | 201342346 | A | 10/2013 |

* cited by examiner

*Primary Examiner* — Aneeta Yodichkas
(74) *Attorney, Agent, or Firm* — Winston Hsu

(57) ABSTRACT

An image display method includes setting a plurality of frame rate intervals and a plurality of backlight driving signal adjustment modes, acquiring a data clock signal, detecting a first frame rate of the data clock signal, adjusting a first power distribution of a backlight driving signal according to a first backlight driving signal adjustment mode of the plurality of backlight driving signal adjustment modes when the first frame rate falls into a first frame rate interval of the plurality of frame rate intervals, and displaying an image according to at least the data clock signal and the backlight driving signal.

14 Claims, 4 Drawing Sheets

IMAGE DISPLAY METHOD AND IMAGE DISPLAY SYSTEM CAPABLE OF STABILIZING IMAGE BRIGHTNESS

BACKGROUND OF THE INVENTION

1. Field of the Invention

The present invention illustrates an image display method and an image display system, and more particularly, an image display method and an image display system capable of stabilizing image brightness and reducing image flickers.

2. Description of the Prior Art

Liquid crystal display (LCD) and organic light-emitting diode (OLED) display devices have been widely used for applying to multimedia products, mobile phones, personal digital assistants, computer monitors, or flat-screen TVs since they have advantages of low power consumption, no radiation, and slim bodies.

Nowadays, many advanced display devices are often used for displaying images of video games or movies. For the video games or movies, their images include a lot of motion objects. Therefore, in order to provide a satisfactory quality of visual experience, the advanced display devices can perform a function of "Dynamic Accuracy (DyAc)". The DyAc function can be used for enhancing sharpness of a dynamic motion image. Therefore, the DyAc function is helpful for mitigating severe image vibrations, especially in images of video games or movies. Further, the advanced display devices also have a function of dynamically refreshing a frame rate (i.e., such as a free sync function). The free sync function can be used for displaying images by dynamically adjusting the frame rate according to video data rendered by a game console or a graphics card. In other words, when the display device receives the video data having a non-constant frame rate (30-240 Hertz), it can use the free sync function for displaying the images.

However, when the free sync function and the DyAc function are enabled for enhancing the sharpness of the dynamic motion images transmitted by using the non-constant frame rate, human eyes easily perceive image flickers, especially in the frame rate lower than 100 Hertz. Further, when the free sync function is enabled, since the frame rate is varied over time, image brightness may be unstable. Therefore, for current display devices, after the free sync function and the DyAc function are enabled, since the image flickers are severe and the image brightness is unstable when the frame rate is low, the quality of visual experience may be decreased.

SUMMARY OF THE INVENTION

In an embodiment of the present invention, an image display method is disclosed. The image display method comprises setting a plurality of frame rate intervals and a plurality of backlight driving signal adjustment modes, acquiring a data clock signal, detecting a first frame rate of the data clock signal, adjusting a first power distribution of a backlight driving signal according to a first backlight driving signal adjustment mode of the plurality of backlight driving signal adjustment modes when the first frame rate falls into a first frame rate interval of the plurality of frame rate intervals, and displaying an image according to at least the data clock signal and the backlight driving signal.

In another embodiment of the present invention, an image display system is disclosed. The image display system comprises a display panel, a driving circuit, a processor, a backlight device, and a memory. The display panel comprises a plurality of pixels and is configured to display an image. The driving circuit is coupled to the display panel and configured to drive the plurality of pixels. The processor is coupled to the driving circuit and configured to control the driving circuit. The backlight device is coupled to the processor and configured to generate a backlight signal. The memory is coupled to the processor and configured to save data of a plurality of frame rate intervals and data of a plurality of backlight driving signal adjustment modes. After the processor acquires a data clock signal transmitted from a signal source, the processor detects a first frame rate of the data clock signal. The processor adjusts a first power distribution of a backlight driving signal according to a first backlight driving signal adjustment mode of the plurality of backlight driving signal adjustment modes when the first frame rate falls into a first frame rate interval of the plurality of frame rate intervals. The backlight device generates the backlight signal according to the backlight driving signal. The driving circuit drives the display panel for displaying the image according to at least the data clock signal and the backlight driving signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
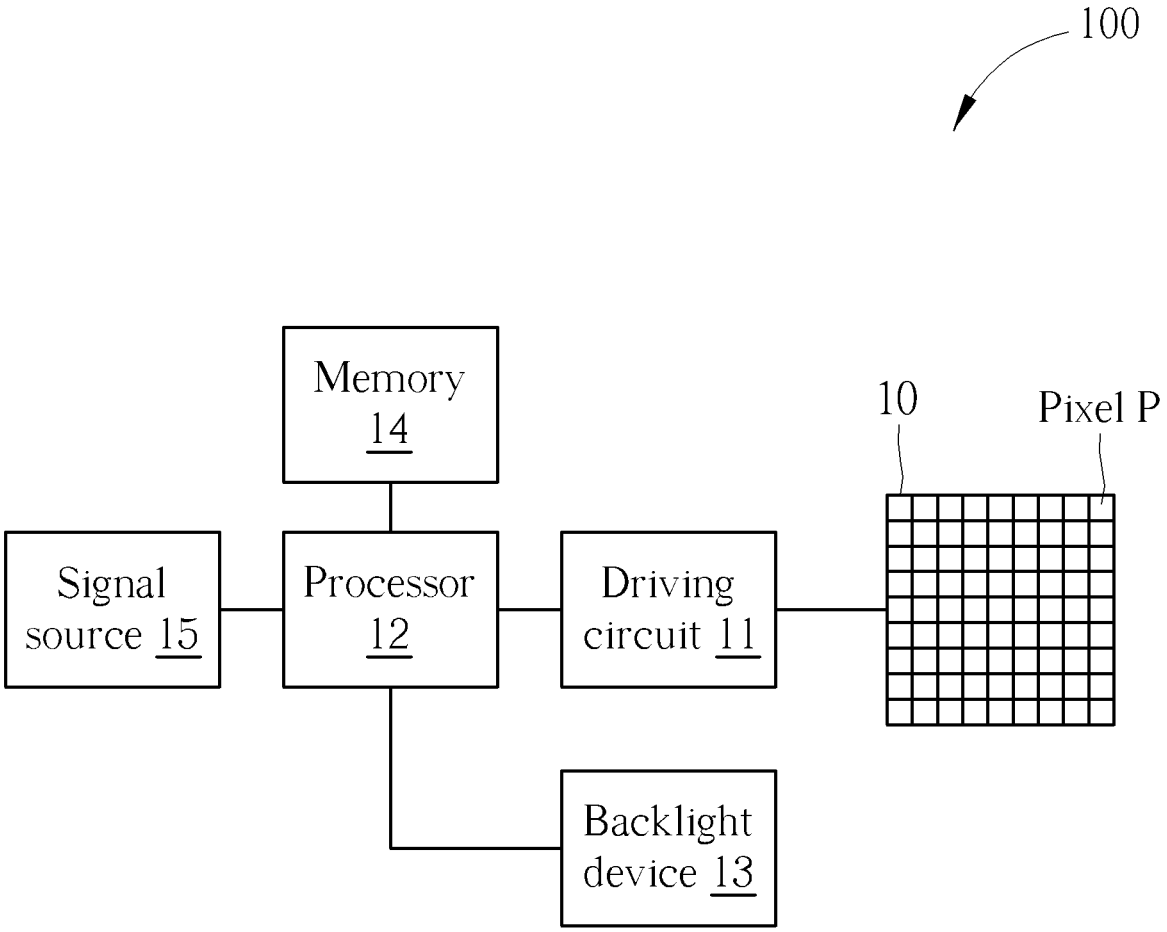
FIG. 1 is a block diagram of an image display system according to an embodiment of the present invention.

FIG. 1 is a block diagram of an image display system 100 according to an embodiment of the present invention. The image display system 100 includes a display panel 10, a driving circuit 11, a processor 12, a backlight device 13, a memory 14, and a signal source 15. The display panel 10 can be any type of display panels, such as a display panel of a liquid crystal display (LCD) device or a display panel of an organic light-emitting diode (OLED) display device. The display panel 10 includes a plurality of pixels P for displaying an image. The plurality of pixels P can be allocated in a form of a pixel array for displaying a rectangular image. The driving circuit 11 is coupled to the display panel 10 for driving the plurality of pixels P. The driving circuit 11 can include any circuit component for driving the plurality of pixels P, such as a gate driving circuit and a data driving circuit. For example, the gate driving circuit can generate gate voltages for controlling control terminals of the plurality of pixels P by using a row by row scanning process.

Therefore, the plurality of pixels P can be controlled to enter an enabling state or a disabling state. The data driving circuit can transmit data voltages to the plurality of pixels P. Therefore, the plurality of pixels P can display various colors and gray levels. The processor 12 is coupled to the driving circuit 11 for controlling the driving circuit 11. The processor 12 can be a scaler disposed inside the display system 100 or can be a microprocessor capable of performing at least one programmable operation. The processor 12 can save a plurality of timing control parameters. Further, the processor 12 can be integrated into a timing controller for determining various timing clock signals of the driving circuit 11 to scan the plurality of pixels P. The backlight device 13 is coupled to the processor 12 for generating a backlight signal. The backlight device 13 can be any controllable light-emitting device. For example, the backlight device 13 can be a light-emitting diode (LED) array, an incandescent light bulb, an electroluminescent panel (ELP), or a cold cathode fluorescent lamp (CCFL). The memory 14 is coupled to the processor 12 for saving data of a plurality of frame rate intervals and data of a plurality of backlight driving signal adjustment modes. In the display system 100, the processor 12 can receive a data clock signal transmitted from the signal source 15. The signal source 15 can be a graphics card of a computer or a DVD player.

In the display system 100, after the processor 12 acquires the data clock signal transmitted from the signal source 15, the processor 12 can detect a first frame rate of the data clock signal. The processor 12 can adjust a first power distribution of a backlight driving signal according to a first backlight driving signal adjustment mode of the plurality of backlight driving signal adjustment modes saved in the memory 14 when the first frame rate falls into a first frame rate interval of the plurality of frame rate intervals. Then, the backlight device 13 can generate the backlight signal according to the backlight driving signal. The driving circuit 11 can drive the display panel 10 for displaying the image according to at least the data clock signal and the backlight driving signal. Further, the image display system 100 can provide a function of dynamically refreshing the frame rate (say, "a free sync function" hereafter). Therefore, the first frame rate of the data clock signal is varied over time. For example, a range of the first frame rate can be 30-240 Hertz. The plurality of frame rate intervals and the plurality of backlight driving signal adjustment modes saved in the memory 14 can be illustrated in Table T1.

TABLE T1

| frame rate FR intervals | backlight driving signal adjustment modes |
|---|---|
| FR ≤ 40 Hertz | adjusting a frequency of the backlight driving signal to approach triple frame rates for driving the backlight device 13 |
| 40 Hertz < FR < 100 Hertz | adjusting a frequency of the backlight driving signal to approach double frame rates for driving the backlight device 13 |
| FR ≥ 100 Hertz | adjusting a frequency of the backlight driving signal to approach the frame rate for driving the backlight device 13 |

However, decision boundaries and intervals listed in Table T1 are the embodiment of the display system 100. Any reasonable frame rate interval modification or backlight driving signal adjustment mode falls into the scope of the present invention. Details of each backlight driving signal adjustment mode are illustrated below.

Figure 2:
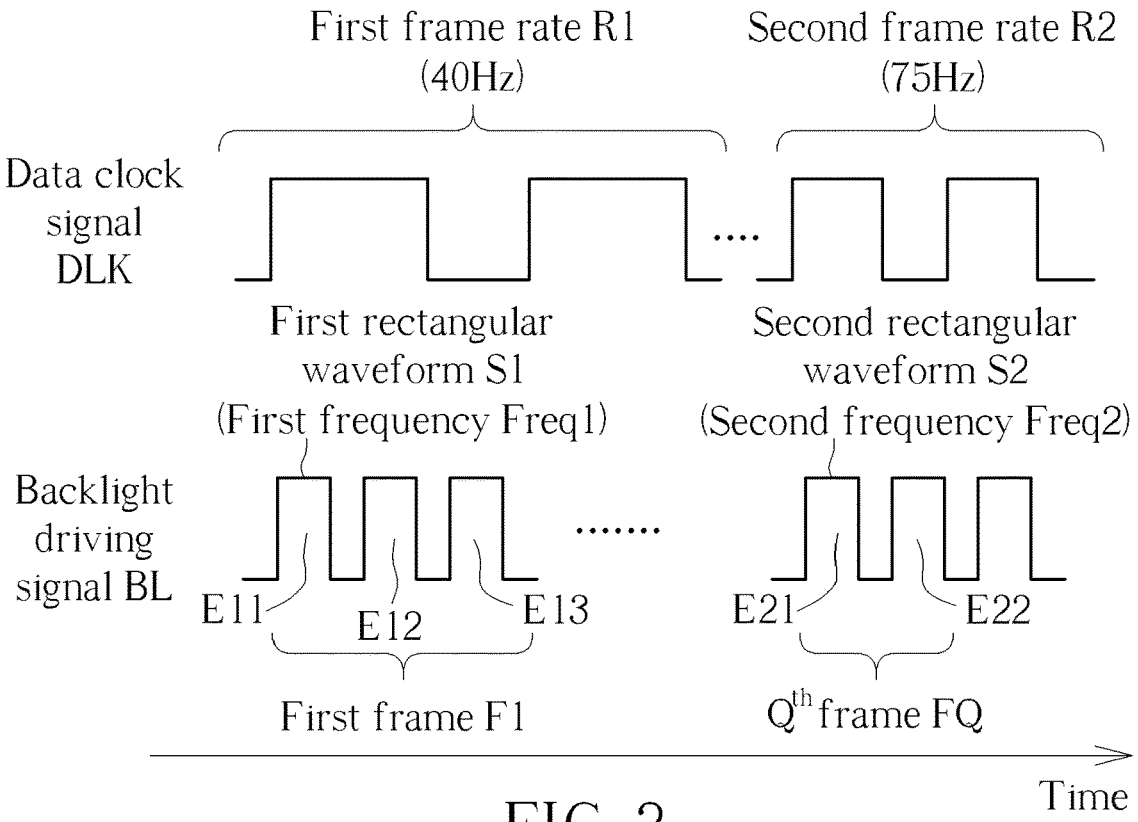
FIG. 2 is an illustration of a first correlation between a data clock signal and a backlight driving signal of the image display system in FIG. 1.

FIG. 2 is an illustration of a first correlation between a data clock signal DLK and a backlight driving signal BL of the image display system 100. Adjustment modes of the backlight driving signal BL in FIG. 2 can be referred to Table T1. In other words, a frequency of the backlight driving signal BL in FIG. 2 can be adjusted according to Table T1. In FIG. 2, an X-axis is denoted as a time line. First, the processor 12 detects a first frame rate R1 of the data clock signal DLK generated by the signal source 15. For example, the first frame rate R1 is 40 Hertz. When the first frame rate R1 is 40 Hertz, the first frame rate R1 falls into a first frame rate interval as "FR 40 Hertz" in Table T1. Therefore, the processor 12 can adjust the frequency of the backlight driving signal BL to approach triple frame rates for driving the backlight device 13. As shown in FIG. 2, during a first frame F1 interval, the processor 12 can adjust the frequency of the backlight driving signal BL to approach triple first frame rates R1 (i.e., 3×R1=3×40=120 Hertz). Such adjusted frequency of the backlight driving signal BL is denoted as "a first frequency Freq1" hereafter. In other words, in the first frame F1 interval, the backlight driving signal BL includes three first rectangular waveforms S1 having power E11, power E12, and power E13. Here, the power of a rectangular waveform is defined as an integrated value of its area. Therefore, although the first frame rate R1 (40 Hertz) of the data clock signal DLK is low, the first frequency Freq1 of the backlight driving signal BL is set to 120 Hertz. Therefore, even if a dynamic accuracy (DyAc) function is enabled in the image display system 100, the image flickers can be mitigated or eliminated. As previously mentioned, the image display system 100 can provide the free sync function. Therefore, the first frame rate R1 of the data clock signal DLK is varied over time. For example, the range of the first frame rate R1 can be 30-240 Hertz. Therefore, after Q frame intervals elapse, the processor 12 can detect a frequency shift of the data clock signal DLK from the first frame rate R1 to a second frame rate R2. For example, the second frame rate R2 can be 75 Hertz. Then, the processor 12 can determine that the second frame rate R2 falls into a second frame rate interval as "40 Hertz<FR<100 Hertz" in Table T1. Therefore, the processor 12 can adjust the frequency of the backlight driving signal BL to approach double frame rates for driving the backlight device 13. As shown in FIG. 2, during the $Q^{th}$ frame FQ interval, the processor 12 can adjust the frequency of the backlight driving signal BL to approach double second frame rates R2 (i.e., 2×R2=2×75=150 Hertz). Such adjusted frequency of the backlight driving signal BL is denoted as "a second frequency Freq2" hereafter. Therefore, the image flickers can also be mitigated or eliminated. In other words, since the image flickers are prone to occur for the frame rate smaller than 100 Hertz, the human eyes may feel uncomfortable for a low frame rate. Therefore, the image display system 100 can dynamically adjust the frequency of the backlight driving signal BL according to a received current frame rate of the data clock signal DLK. Further, since the frequency of the backlight driving signal BL (i.e., for example, the first frequency Freq1=120 Hz or the second frequency Freq2=150 Hz) is greater than 100 Hz, the image flickers can be mitigated.

In other words, for the first frame rate R1 of the data clock signal DLK, the processor 12 can adjust the first frequency Freq1 of the backlight driving signal BL according to the first backlight driving signal adjustment mode (i.e., as shown in Table T1) of the plurality of backlight driving signal adjustment modes saved in the memory 14. The processor 12 can adjust the first frequency Freq1 of the backlight driving signal BL to approach N times of the first frame rate R1 of the data clock signal DLK according to the first backlight driving signal adjustment mode. N is a positive integer. Further, when the first frame rate R1 of the data clock signal DLK is increased, the processor 12 can decrease a value of N. As shown in Table T1, when the first frame rate R1 falls into a frame interval of "FR≤40 Hertz", N is set to 3. When the first frame rate R1 falls into a frame interval of "40 Hertz<FR<100 Hertz", N is set to 2. When the first frame rate R1 falls into a frame interval of "FR≥100 Hertz", N is set to 1. A frequency adjustment method of the backlight driving signal BL according to the second frame rate R2 is similar to the frequency adjustment method of the backlight driving signal BL according to the first frame rate R1. Thus, their details are omitted here.

Further, the image display system 100 can adjust a waveform of the backlight driving signal BL. The processor 12 can adjust a first power distribution of the backlight driving signal BL according to the first backlight driving signal adjustment mode of the plurality of backlight driving signal adjustment modes saved in the memory 14. For example, as previously mentioned, during the first frame F1 interval, the first frequency Freq1 of the backlight driving signal BL can be adjusted to approach triple first frame rates R1 (3×R1=3×40=120 Hertz). Further, the processor 12 can adjust the power E11, the power E12, and the power E13 of a plurality of first rectangular waveforms S1 of the backlight driving signal BL during the first frame F1 interval. Similarly, during the $Q^{th}$ frame FQ interval, the second frequency Freq2 of the backlight driving signal BL can be adjusted to approach double second frame rates R2 (2×R2=2×75=150 Hertz). Further, the processor 12 can adjust the power E21 and the power E22 of a plurality of second rectangular waveforms S2 of the backlight driving signal BL during the $Q^{th}$ frame FQ interval. Therefore, by adjusting the rectangular waveforms of the backlight driving signal BL, the display system 100 can reconfigure the power distribution of the backlight driving signal BL during each frame interval. Further, the power values of the backlight driving signal BL during all frame intervals of the data clock signal DLK are substantially identical. For example, the power values of the backlight driving signal BL can satisfy a condition of E11+E12+E13≈E21+E22. By doing so, since the power values of the backlight driving signal BL during all frame intervals are substantially identical, the image brightness can be stabilized, leading to satisfactory quality of visual experience.

Figure 3:
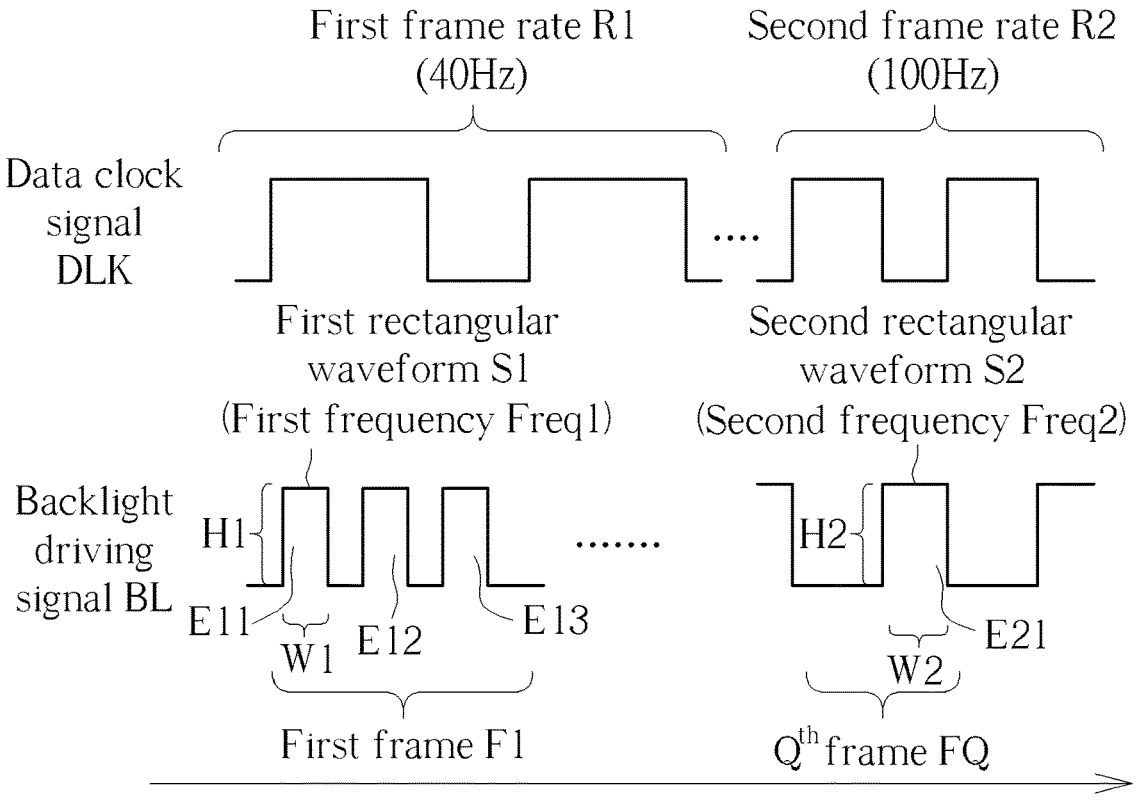
FIG. 3 is an illustration of a second correlation between the data clock signal and the backlight driving signal of the image display system in FIG. 1.

FIG. 3 is an illustration of a second correlation between the data clock signal DLK and the backlight driving signal BL of the image display system 100. In FIG. 3, an X-axis is denoted as the time line. Similarly, the processor 12 detects a first frame rate R1 of the data clock signal DLK generated by the signal source 15. For example, the first frame rate R1 is 40 Hertz. When the first frame rate R1 is 40 Hertz, the first frame rate R1 falls into the first frame rate interval as "FR 40 Hertz" in Table T1. Therefore, the processor 12 can adjust the frequency of the backlight driving signal BL to approach triple frame rates for driving the backlight device 13. As shown in FIG. 3, during the first frame F1 interval, the processor 12 can adjust the frequency of the backlight driving signal BL to approach triple first frame rates R1 (i.e., 3×R1=3×40=120 Hertz). After Q frame intervals elapse, the processor 12 detects a frequency shift of the data clock signal DLK from the first frame rate R1 to a second frame rate R2. For example, the second frame rate R2 can be 100 Hertz. Then, the processor 12 can determine that the second frame rate R2 falls into a third frame rate interval as "FR≥100 Hertz" in Table T1. Therefore, the processor 12 can adjust the frequency of the backlight driving signal BL to approach the second frame rate R2 for driving the backlight device 13. As shown in FIG. 3, during the $Q^{th}$ frame FQ interval, the processor 12 can adjust the frequency of the backlight driving signal BL to approach the second frame rates R2 (i.e., R2=100 Hertz). Such adjusted frequency of the backlight driving signal BL is denoted as "a second frequency Freq2" hereafter. Further, the backlight driving signal BL includes at least one rectangular waveform. The processor 12 can adjust a height and/or a width of the at least one rectangular waveform. For example, during the first frame F1 interval, the backlight driving signal BL can include three first rectangular waveforms S1. The processor 12 can adjust a height H1 and/or a width W1 of each first rectangular waveform S1. As previously mentioned, the power of the rectangular waveform is defined as the integrated value of its area. Therefore, the first rectangular waveform S1 having the first height H1 and the first width W1 corresponds to the power E11=W1×H1. By doing so, the processor 12 can adjust the distribution of the power E11, the power E12, and the power E13 of the backlight driving signal BL during the first frame F1 interval. Similarly, during the $Q^{th}$ frame FQ interval, the backlight driving signal BL includes a second rectangular waveform S2. The processor 12 can adjust a height H2 and/or a width W2 of the second rectangular waveform S2. Therefore, the second rectangular waveform S2 having the second height H2 and the second width W2 corresponds to the power E21=W2×H2. By doing so, the processor 12 can adjust the distribution of the power E21 of the backlight driving signal BL during the $Q^{th}$ frame FQ interval.

Further, as previously mentioned, the processor 12 can adjust the power distribution of the backlight driving signal BL. Therefore, after the power distribution of the backlight driving signal BL is adjusted, the power values of the backlight driving signal BL during all frame intervals of the data clock signal DLK are substantially identical, leading to stabilized image brightness. In other words, in FIG. 3, when the first frame rate R1 (40 Hertz) is smaller than the second frame rate R2 (100 Hertz), a power value of a single first rectangular waveform S1 of the backlight driving signal BL under the first power distribution is smaller than a power value of a single second rectangular waveform S2 of the backlight driving signal BL under the second power distribution. Therefore, in FIG. 3, the power of the backlight driving signal BL (i.e., including the plurality of first rectangular waveforms S1) during the first frame F1 interval can be adjusted to approach the power of the backlight driving signal BL (i.e., including a single second rectangular waveforms S2) during the $Q^{th}$ frame FQ interval. Conversely, when the first frame rate R1 is greater than the second frame rate R2, a power value of the single first rectangular waveform S1 of the backlight driving signal BL under the first power distribution is greater than a power value of the single second rectangular waveform S2 of the backlight driving signal under the second power distribution. Further, power values of the plurality of first waveforms S1 configured by the image display system 100 can be substantially identical, such as E11≈E12≈E13. Therefore, during the first frame F1 interval, the stability of the image brightness can be further improved.

In the image display system 100, the processor 12 can adjust the frequency of the backlight driving signal BL and/or can adjust the rectangular waveforms of the backlight driving signal BL according to an appropriate backlight driving signal adjustment mode of the plurality of backlight driving signal adjustment modes saved in the memory 14. When the frequency of the backlight driving signal BL is increased, the image flicks can be avoided. When the rectangular waveforms of the backlight driving signal BL are adjusted, power values of the backlight driving signal BL during all frame intervals are substantially identical, thereby leading to high stability of the image brightness. However, the power distributions of the backlight driving signal BL are not limited to satisfying E11+E12+E13≈E21+E22 or E11≈E12≈E13. Any reasonable technology for stabilizing the image brightness falls into the scope of the present invention.

Figure 4:
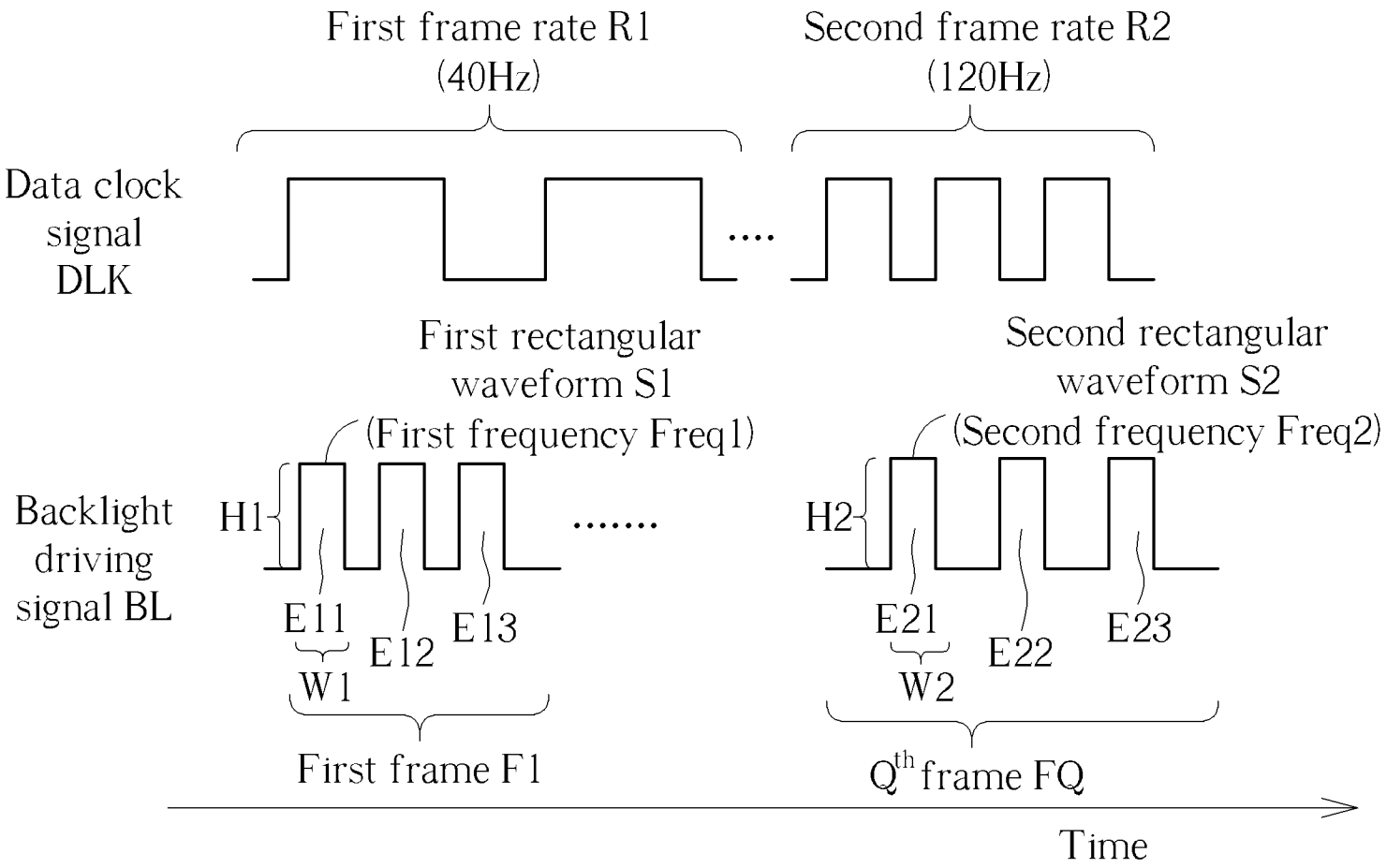
FIG. 4 is an illustration of a third correlation between the data clock signal and the backlight driving signal of the image display system in FIG. 1.

FIG. 4 is an illustration of a third correlation between the data clock signal CLK and the backlight driving signal BL of the image display system 100. In FIG. 4, an X-axis is denoted as the time line. Similarly, the processor 12 detects the first frame rate R1 of the data clock signal DLK generated by the signal source 15. For example, the first frame rate R1 is 40 Hertz. When the first frame rate R1 is 40 Hertz, the first frame rate R1 falls into the first frame rate interval as "FR 40 Hertz" in Table T1. Therefore, the processor 12 can adjust the first frequency Freq1 of the backlight driving signal BL to approach triple first frame rates R1 (i.e., 3×R1=3×40=120 Hertz). When the second frame rate R2 is 120 Hertz, the second frame rate R2 falls into the third frame rate interval as "FR≥100 Hertz" in Table T1. Therefore, the processor 12 can adjust the second frequency Freq2 of the backlight driving signal BL to approach the second frame rate R2 for driving the backlight device 13. Therefore, during the $Q^{th}$ frame FQ interval, the second frequency Freq2 is equal to 120 Hertz. Therefore, in FIG. 4, after the backlight driving signal BL is adjusted, the first frequency Freq1 and the second frequency Freq2 are exactly identical (120 Hertz). In other words, in some special frame rates, the frequency of the backlight driving signal BL can be a constant. The processor 12 can further adjusted rectangular waveforms of the backlight driving signal BL. However, details of adjusting the width W1 and/or the height H1 of each first rectangular waveform S1, adjusting the width W2 and/or the height H2 of each second rectangular waveform S2, and adjusting the power distribution of the power E11, the power E12, the power E13, the power E21, the power E22, and the power E23 are previously illustrated. Thus, they are omitted here.

Further, the method of adjusting the power distribution of the backlight driving signal BL is not limited to technologies in FIG. 2 to FIG. 4. In FIG. 2, the power distribution of the plurality of first rectangular waveforms S1 and the plurality of second rectangular waveforms S2 can be reasonably adjusted. For example, the first rectangular waveform S1 having the power E13 can be generated during a blanking interval of the first frame F1. The first rectangular waveforms S1 having the power E11 and the power E12 can be generated during any two periods during an active interval of the first frame F1. Further, the second rectangular waveform S2 having the power E22 can be generated during a blanking interval of the $Q^{th}$ frame FQ. The second rectangular waveform S2 having the power E21 can be generated during any period during an active interval of the $Q^{th}$ frame FQ. Any reasonable technology for adjusting the power distribution of the backlight driving signal BL falls into the scope of the present invention.

In the image display system 100, the processor 12 can adjust the power distribution and the frequency of the backlight driving signal BL for avoiding the image flickers and stabilizing the image brightness. However, the image display system 100 can introduce hybrid modes for further enhancing the visual quality. For example, in the image display system 100, the memory 14 can save data of a plurality of over drive modes (OD modes). When the first frame rate R1 falls into the first frame rate interval of the plurality frame rate intervals, the processor 12 can use one OD mode of the plurality of OD modes to accelerate driving pixels. When the plurality of OD modes are introduced to the image display system 100, a plurality of hybrid modes can be generated by integrating the backlight driving signal adjustment modes with the OD modes, as illustrated in Table T2.

TABLE T2

| frame rate FR intervals | backlight driving signal adjustment modes and OD modes (hybrid modes) |
|---|---|
| FR ≤ 40 Hertz | A) adjusting a frequency of the backlight driving signal to approach triple frame rates for driving the backlight device 13<br>B) OD mode: Weak |
| 40 Hertz < FR < 100 Hertz | A) adjusting a frequency of the backlight driving signal to approach double frame rates for driving the backlight device 13<br>B) OD mode: medium |
| FR ≥ 100 Hertz | A) adjusting a frequency of the backlight driving signal to approach the frame rate for driving the backlight device 13<br>B) OD mode: strong |

Here, the image display system 100 can introduce the plurality of OD modes for setting the pixel driving voltage. When an intensity of the pixel driving voltage is large, it implies that a transient time length of refreshing liquid crystal molecules of the pixel is short. Therefore, when the first frame rate R1 of the data clock signal DLK is small (i.e., for example, the first frame rate R1 is smaller than 40 Hertz), it implies that the signal source 15 generates a static image or an image having slow motion objects, such as an image of text documents. Therefore, the OD mode can be set to a "weak" mode. Then, the processor 12 can use a pixel driving voltage having a small intensity for driving the display panel 10. When the first frame rate R1 of the data clock signal DLK is large (i.e., for example, the first frame rate R1 is greater than 100 Hertz), it implies that the signal source 15 generates a dynamic image or an image having fast motion objects, such as an image of video games. Therefore, the OD mode can be set to a "strong" mode. Then, the processor 12 can use a pixel driving voltage having a large intensity for driving the display panel 10. After the display panel 10 is driven by the pixel driving voltage having the large intensity, an image sticking effect can be mitigated. Therefore, after the image display system 100 adjusts the power distribution of the backlight driving signal BL and introduces the plurality of OD modes, the image display system 100 can reduce the image flickers, stabilize the image brightness, and mitigate the image sticking effect. Thus, the image display system 100 can greatly improve the quality of visual experience.

Figure 5:
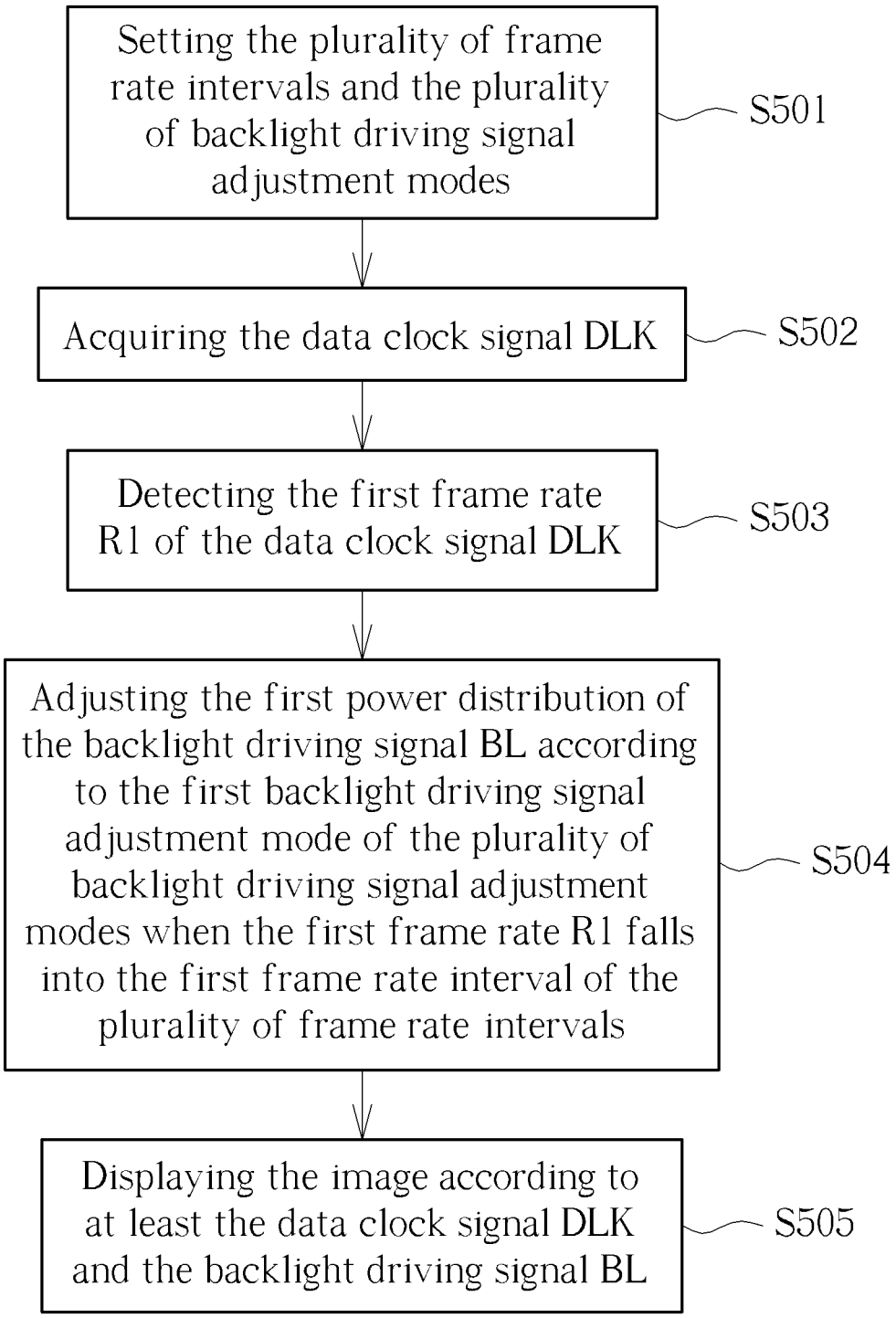
FIG. 5 is a flow chart of an image display method performed by the image display system in FIG. 1.

FIG. 5 is a flow chart of an image display method performed by the image display system 100. The image display system 100 includes step S501 to step S505. Any reasonable technology modification falls into the scope of the present invention. Details of step S501 to step S505 are illustrated below.

step S501: setting the plurality of frame rate intervals and the plurality of backlight driving signal adjustment modes;

step S502: acquiring the data clock signal DLK;

step S503: detecting the first frame rate R1 of the data clock signal DLK;

step S504: adjusting the first power distribution of the backlight driving signal BL according to the first backlight driving signal adjustment mode of the plurality of backlight driving signal adjustment modes when the first frame rate R1 falls into the first frame rate interval of the plurality of frame rate intervals;

step S505: displaying the image according to at least the data clock signal DLK and the backlight driving signal BL.

Details of step S501 to step S505 are previously illustrated. Therefore, they are omitted here. By adjusting the backlight driving signal BL, the image display system 100 can avoid generating the image flickers and can stabilize the image brightness. In other words, even if the image display system 100 performs the free sync function, the frequency of the backlight driving signal BL can be dynamically adjusted. The adjusted frequency is greater than a threshold (i.e., greater than 100 Hertz) for any frame rate. Therefore, the image flickers can be avoided. By doing so, the image display system 100 can increase the quality of visual experience.

To sum up, the present invention illustrates an image display method and an image display system. The image display system can dynamically adjust a frequency of a backlight driving signal according to frame rate variability of a data clock signal. When the frame rate of the data clock signal is very low, the image display system can increase the frequency of the backlight driving signal to avoid perceiving image flickers by human eyes. Further, the image display system can also adjust a height and/or a width of rectangular waveforms of the backlight driving signal for optimizing power distribution of the backlight driving signal during all image frames, thereby leading to high stability of the image brightness. Further, the image display system can also introduce a plurality of OD modes for mitigating an image sticking effect. Therefore, the image display system 100 can reduce the image flickers, stabilize the image brightness, and mitigate the image sticking effect. Thus, the image display system 100 can greatly improve the quality of visual experience.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image display method comprising:

setting a plurality of frame rate intervals and a plurality of backlight driving signal adjustment modes;

acquiring a data clock signal;

detecting a first frame rate of the data clock signal;

adjusting a first frequency of a backlight driving signal to approach N times of the first frame rate of the data clock signal for adjusting a first power distribution of the backlight driving signal according to a first backlight driving signal adjustment mode of the plurality of backlight driving signal adjustment modes when the first frame rate falls into a first frame rate interval of the plurality of frame rate intervals; and displaying an image according to at least the data clock signal and the backlight driving signal;

wherein N is a positive integer.

2. The method of claim 1, wherein the first frame rate of the data clock signal is varied over time.

3. The method of claim 1, further comprising:

detecting a frequency shift of the data clock signal from the first frame rate to a second frame rate; and adjusting a second power distribution of the backlight driving signal according to a second backlight driving signal adjustment mode of the plurality of backlight driving signal adjustment modes when the second frame rate falls into a second frame rate interval of the plurality of frame rate intervals;

wherein power values of the backlight driving signal during all frame intervals of the data clock signal are identical.

4. The method of claim 3, wherein when the first frame rate is greater than the second frame rate, a power value of a first rectangular waveform of the backlight driving signal under the first power distribution is greater than a power value of a second rectangular waveform of the backlight driving signal under the second power distribution.

5. The method of claim 3, wherein when the first frame rate is smaller than the second frame rate, a power value of a first rectangular waveform of the backlight driving signal under the first power distribution is smaller than a power value of a second rectangular waveform of the backlight driving signal under the second power distribution.

6. The method of claim 1, wherein the backlight driving signal comprises at least one first rectangular waveform, and the method further comprises: adjusting a first height and/or a first width of the at least one first rectangular waveform according to the first backlight driving signal adjustment mode of the plurality of backlight driving signal adjustment modes.

7. The method of claim 1, wherein when the first frame rate of the data clock signal is increased, N is decreased.

8. An image display system comprising:

a display panel comprising a plurality of pixels and configured to display an image;

a driving circuit coupled to the display panel and configured to drive the plurality of pixels;

a processor coupled to the driving circuit and configured to control the driving circuit;

a backlight device coupled to the processor and configured to generate a backlight signal; and a memory coupled to the processor and configured to save data of a plurality of frame rate intervals and data of a plurality of backlight driving signal adjustment modes;

wherein after the processor acquires a data clock signal transmitted from a signal source, the processor detects a first frame rate of the data clock signal, the processor adjusts a first frequency of a backlight driving signal to approach N times of the first frame rate of the data clock signal for adjusting a first power distribution of the backlight driving signal according to a first backlight driving signal adjustment mode of the plurality of backlight driving signal adjustment modes when the first frame rate falls into a first frame rate interval of the plurality of frame rate intervals, the backlight device generates the backlight signal according to the backlight driving signal, the driving circuit drives the display panel for displaying the image according to at least the data clock signal and the backlight driving signal, and N is a positive integer.

9. The system of claim 8, wherein the first frame rate of the data clock signal is varied over time.

10. The system of claim 8, wherein the processor detects a frequency shift of the data clock signal from the first frame rate to a second frame rate, the processor adjusts a second power distribution of the backlight driving signal according to a second backlight driving signal adjustment mode of the plurality of backlight driving signal adjustment modes when the second frame rate falls into a second frame rate interval of the plurality of frame rate intervals, and power values of the backlight driving signal during all frame intervals of the data clock signal are identical.

11. The system of claim 10, wherein when the first frame rate is greater than the second frame rate, a power value of a first rectangular waveform of the backlight driving signal under the first power distribution is greater than a power value of a second rectangular waveform of the backlight driving signal under the second power distribution.

12. The system of claim 10, wherein when the first frame rate is smaller than the second frame rate, a power value of a first rectangular waveform of the backlight driving signal under the first power distribution is smaller than a power value of a second rectangular waveform of the backlight driving signal under the second power distribution.

13. The system of claim 8, wherein the backlight driving signal comprises at least one first rectangular waveform, and the processor adjusts a first height and/or a first width of the at least one first rectangular waveform according to the first backlight driving signal adjustment mode of the plurality of backlight driving signal adjustment modes saved in the memory.

14. The system of claim 8, wherein when the first frame rate of the data clock signal is increased, N is decreased.

* * * * *